US010371452B2

(12) United States Patent
Veilleux, Jr. et al.

(10) Patent No.: US 10,371,452 B2
(45) Date of Patent: Aug. 6, 2019

(54) HEAT EXCHANGER WITH SUPPORT STRUCTURE

(71) Applicant: Hamilton Sundstrand Corporation, Charlotte, NC (US)

(72) Inventors: Leo J. Veilleux, Jr., Wethersfield, CT (US); Lubomir A. Ribarov, West Hartford, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 138 days.

(21) Appl. No.: 15/290,014

(22) Filed: Oct. 11, 2016

(65) Prior Publication Data

US 2018/0100702 A1 Apr. 12, 2018

(51) Int. Cl.

| | |
|---|---|
| ***F28D 7/00*** | (2006.01) |
| ***F28F 13/06*** | (2006.01) |
| ***F28F 9/013*** | (2006.01) |
| ***F28F 13/00*** | (2006.01) |
| ***F28F 1/12*** | (2006.01) |
| *F28F 3/04* | (2006.01) |
| *F28F 9/22* | (2006.01) |

(52) U.S. Cl.

CPC ..... *F28D 7/0066* (2013.01); *F28F 1/122* (2013.01); *F28F 9/013* (2013.01); *F28F 13/003* (2013.01); *F28F 13/06* (2013.01); *F28F 3/048* (2013.01); *F28F 9/22* (2013.01); *F28F 2260/00* (2013.01); *F28F 2260/02* (2013.01)

(58) Field of Classification Search

CPC ..... F28D 7/0066; F28F 9/013; F28F 2260/00; F28F 2260/02; F28F 13/003; F28F 3/048; F28F 9/22

USPC ..... 165/159, 160, 161

See application file for complete search history.

(56) References Cited

U.S. PATENT DOCUMENTS

| | | | | |
|---|---|---|---|---|
| 3,147,743 A * | 9/1964 | Romanos | F22B 1/021 122/32 |
| 4,570,703 A * | 2/1986 | Ringsmuth | F28F 9/0132 165/162 |
| 2009/0084520 A1* | 4/2009 | Campagna | B21D 53/02 165/46 |

FOREIGN PATENT DOCUMENTS

| | | | |
|---|---|---|---|
| DE | 102008041556 | A1 | 3/2010 |
| GB | 2531945 | A | 5/2016 |
| WO | 2002042707 | A1 | 5/2002 |
| WO | 2011026483 | A2 | 3/2011 |
| WO | 2013163398 | A1 | 10/2013 |

OTHER PUBLICATIONS

Search Report dated Feb. 9, 2018, EP Application No. 17195758.2, 6 pages.

* cited by examiner

*Primary Examiner* — Joel M Attey
(74) *Attorney, Agent, or Firm* — Cantor Colburn LLP

(57) ABSTRACT

A tubular heat exchanger includes a first flow path to receive a first fluid flow, wherein the first flow path is defined by a conduit, and a support structure with a plurality of support structure openings, wherein the support structure supports the first flow path, the plurality of support structure openings define a second flow path to receive a second fluid flow, and the first flow path is in thermal communication with the second flow path.

16 Claims, 1 Drawing Sheet

HEAT EXCHANGER WITH SUPPORT STRUCTURE

BACKGROUND

The subject matter disclosed herein relates to heat exchangers, and more particularly, to heat exchangers for aircraft.

Heat exchangers can be utilized within an aircraft to transfer heat from one fluid to another. Aircraft heat exchangers are designed to transfer a desired amount of heat from one fluid to another. Often, heat exchangers that provide a desired amount of heat transfer may be large and heavy.

BRIEF SUMMARY

According to an embodiment, a tubular heat exchanger includes a first flow path to receive a first fluid flow, wherein the first flow path is defined by a conduit, and a support structure with a plurality of support structure openings, wherein the support structure supports the first flow path, the plurality of support structure openings define a second flow path to receive a second fluid flow, and the first flow path is in thermal communication with the second flow path.

Technical function of the embodiments described above includes a support structure with a plurality of support structure openings, wherein the support structure supports the first flow path and the plurality of support structure openings define a second flow path to receive a second fluid flow.

Other aspects, features, and techniques of the embodiments will become more apparent from the following description taken in conjunction with the drawings.

BRIEF DESCRIPTION OF THE DRAWINGS

The subject matter is particularly pointed out and distinctly claimed in the claims at the conclusion of the specification. The foregoing and other features, and advantages of the embodiments are apparent from the following detailed description taken in conjunction with the accompanying drawings in which like elements are numbered alike in the FIGURES:

DETAILED DESCRIPTION

Figure 1:
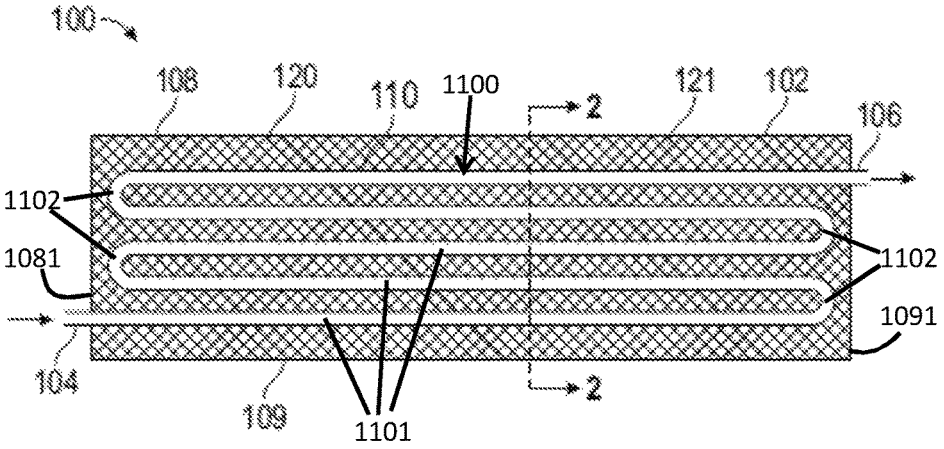
FIG. 1 is a cross sectional view of a heat exchanger.
Figure 2:
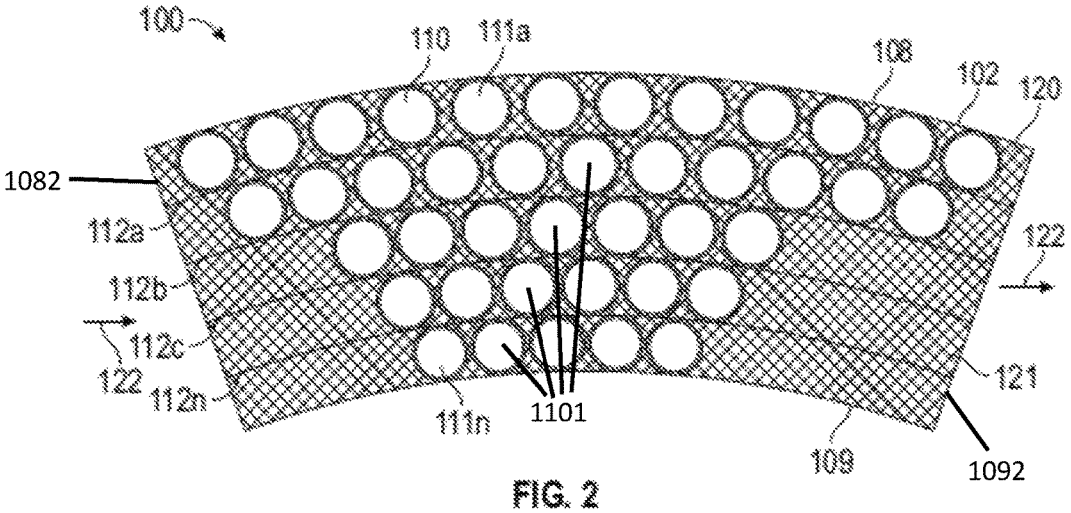
FIG. 2 is a view of the heat exchanger of FIG. 1 along section line 2-2.

Referring to the drawings, FIGS. 1 and 2 show a heat exchanger 100. In the illustrated embodiment, the heat exchanger 100 includes a heat exchanger body 102, a hollow conduit 110, and a support structure 120. The support structure 120 consists of ligaments which can be of either regular (as shown in FIGS. 1 and 2) or irregular geometrical shapes. The thickness and spacing of said ligaments can be either uniform (as shown in FIGS. 1 and 2) or non-uniform. The spacing between the support structure ligaments form support structure openings 121. In the illustrated embodiment, the heat exchanger 100 can provide fluid flow paths through the hollow conduit 110 and the support structure 120 to transfer heat between fluids. Advantageously, the heat exchanger 100 can allow for compact heat exchangers that can provide a desired level of heat transfer while withstanding shock and vibration as well as thermal and pressure gradients. In the illustrated embodiment, the heat exchanger

100 can be suitable for use, for example, as a buffer air cooler, an air-to-air cooler, an air-to-oil cooler, a fuel-to-oil cooler, a refrigerant-to-fuel cooler, a refrigerant-to-air cooler, an aviation electronics (i.e., avionics) cooler, etc.

In the illustrated embodiment, the heat exchanger body 102 includes a top 108 and a bottom 109, front and rear sidewalls 1081 and 1091, as shown in FIG. 1, as well as lateral sidewalls 1082 and 1092, as shown in FIG. 2. As described herein, the heat exchanger body 102 can be any suitable shape. In the illustrated embodiment, the heat exchanger body 102 can be formed generally from the shape of the support structure 120 and therefore can be shaped based on an intended or desired application. The heat exchanger body 102 can have a curved shape (c.f, for an improved conformal fit) wherein the top 108 is longer than the bottom 109 (as shown in FIG. 2). In the illustrated embodiment, the heat exchanger body 102 is a compact and light-weight design. Any other suitable geometrical shapes of the heat exchanger body 102 are equally plausible and contemplated in this disclosure.

In the illustrated embodiment, the hollow conduit 110 includes a flow inlet 104 and a flow outlet 106. The hollow conduit 110 can provide a flow path for a fluid flow through the heat exchanger body 102 from the flow inlet 104 to the flow outlet 106. In the illustrated embodiment, the hollow conduit 110 can provide the flow path for a fluid to be cooled. The fluid within the hollow conduit 110 can include, but is not limited to, air, fuel, hydraulic fluid, oil, refrigerant, water, etc.

In the illustrated embodiment, the hollow conduit 110 facilitates heat transfer between the fluid therein and the support structure 120 and the cooling flow 122 there through. The hollow conduit 110 can have bends, turns, and other features to increase the residence time and heat transfer surface area within the heat exchanger 100. For example, the hollow conduit 110 can have straight sections 1101 that extent through the support structure 120 along longitudinal axes transverse to the curvatures of the top 108 and the bottom 109, as shown in FIGS. 1 and 2, as well as hairpin sections 1102 that connect pairs of straight sections 1101, as shown in FIG. 1. The hollow conduit 110 can have any suitable cross section, including, but not limited to a circular cross section, a square cross section, an elliptical cross section, a hexagonal cross section, etc. In general, the hollow conduit 110 can have any suitable cross section including any regular or irregular polygons.

In certain embodiments, the heat exchanger 100 can include multiple hollow conduits 110 to provide multiple fluid flow paths or circuits. In certain embodiments, multiple hollow conduits 110 can be utilized to cool multiple fluid flows or to increase heat transfer with a single fluid flow. In the illustrated embodiment, multiple hollow conduits 110 can be arranged to minimize the size of the heat exchanger 100 by densely arranging the hollow conduits 110. In the illustrated embodiment, the hollow conduits 110 can be arranged in a staggered arrangement 111*a*-111*n* e.g., a staggered serpentine arrangement 1100 as shown in FIG. 1) to maximize the number of the straight sections 1101 of the hollow conduits 110 that can be disposed in groups within corresponding ones of the multiple intermediate support structure layers 112*a*-112*n* that have similar curvatures as the top 108 and the bottom 109 and increasing lengths from the bottom 109 toward the top 108 (as shown in FIG. 2). The groups of the straight sections 1101 of the hollow conduits 110 disposed within the corresponding ones of the multiple intermediate support structure layers 112*a*-112*n* have respective group curvatures that are similar to the respective curvatures of the corresponding ones of the multiple intermediate support structure layers 112*a*-112*n* (as shown in FIG. 2).

In the illustrated embodiment, the hollow conduits 110 can be individually formed. In other embodiments, the hollow conduits 110 can be formed in conjunction with the support structure 120 described herein. The hollow conduits 110 can be formed using additive manufacturing techniques. In the illustrated embodiment, the hollow conduits 110 are formed through the support structure 120. Hollow conduits 110 can be formed by creating voids in the support structure 120 to create a monolithic construction of the hollow conduits 110 and the support structure 120.

In the illustrated embodiment, the support structure 120 includes a plurality of support structure openings 121. In the illustrated embodiment, cooling flow 122 passes through the support structure 120 via the support structure openings 121. The support structure openings 121 cross-section is at least one of a circle, a square, an ellipse, a hexagon or any other regular or irregular polygon.

The support structure 120 supports the hollow conduits 110 and further facilitates heat transfer with the fluid flow within the hollow conduits 110 and the cooling flow 122.

In the illustrated embodiment, the support structure 120 can be formed from porous metallic foam, porous polymeric foam, lattice type materials, etc. Advantageously, lattice type materials and foam type materials can provide structural support for the heat exchanger 100 while allowing cooling flow 122 there through.

In the illustrated embodiment, the plurality of support structure openings 121 can be pores, voids, or any other suitable opening of the support structure 120. Advantageously, the support structure openings 121 of the support structure 120 reduce the modulus of elasticity of the heat exchanger body 102. By increasing compliance of the heat exchanger body 102, the support structure 120 can allow for natural damping of vibration and shock. Further, increased compliance of the heat exchanger body 102 can allow for the heat exchanger body 102 to conform to external loads and thermal gradients. Further, the support structure 120 and the hollow conduits 110 can be monolithically formed for increased strength and simplified construction.

The support structure openings 121 allow for cooling flow 122 to pass through the support structure 120. Cooling flow 122 can have a continuous flow path from one end of the heat exchanger body 102 to the other end. The flow path defined by the support structure openings 121 allows for cooling flow 122 to take a straight or convoluted path. In the illustrated embodiment, the support structure openings 121 can define multiple flow paths. Advantageously, the integrated flow paths formed by the support structure openings 121 allow for a light, compact, and rigid heat exchanger 100 by improving the density of the heat exchanger 100.

During operation of the heat exchanger 100, a fluid to be cooled can flow from the flow inlet 104 through the hollow conduit 110 to the flow outlet 106. Simultaneously, a cooling flow 122 can pass through the support structure openings 121 to form a flow path from one side of the heat exchanger body 102 to the other side. As both fluids flow through the heat exchanger 100, heat is transferred from the fluid to be cooled (flowing through the hollow conduits 110) to the cooling flow 122. Cooling flow 122 can be gas/vapor, liquid, or any other suitable fluid phase or combination of fluid phases (e.g. two-phase flow (vapor and liquid) as in a typical refrigerant fluid). Alternatively, the cooling fluid may flow through the hollow conduits 110 while the fluid to be cooled may flow through the support structure openings 121 of the heat exchanger 100. In certain embodiments, the heat exchanger 100 can be a cross flow heat exchanger, a counter flow heat exchanger, or any other suitable flow arrangement.

In the illustrated embodiment, the ligaments of the support structure 120 and the hollow conduit 110 can be formed from additive manufacturing methods. Additive manufacturing methods can allow precision in forming the support structure openings 121 as well as other components of the heat exchanger 100.

The materials are not limited to metals and for some applications, polymer heat exchangers can also be utilized. In certain embodiments, additive manufacturing is used to fabricate any part of or all of the heat exchanger structures. Additive manufacturing techniques can be used to produce a wide variety of structures that are not readily producible by conventional manufacturing techniques. Additive manufacturing allows for the customized sculpting of the optimal number, cross-section, and density of both coolant conduits 110 and support structure openings 121. For example, the multitude of dense support structure ligaments of the support structure 120 increases the available surface area for heat transfer, while adding little additional weight to the overall heat exchanger 100. In certain embodiments, the density and thickness of the support structure ligaments can be varied to provide a desired structure and performance. This leads to the optimal (most compact/light-weight) heat exchanger with the minimal pressure drop and the highest heat transfer capabilities.

In certain embodiments, the heat exchanger can be manufactured by advanced additive manufacturing ("AAM") techniques such as (but not limited to): selective laser sintering (SLS) or direct metal laser sintering (DMLS), in which a layer of metal or metal alloy powder is applied to the workpiece being fabricated and selectively sintered according to the digital model with heat energy from a directed laser beam. Another type of metal-forming process includes selective laser melting (SLM) or electron beam melting (EBM), in which heat energy provided by a directed laser or electron beam is used to selectively melt (instead of sinter) the metal powder so that it fuses as it cools and solidifies.

In certain embodiments, the heat exchanger can made of a polymer, and a polymer or plastic forming additive manufacturing process can be used. Such process can include stereolithography (SLA), in which fabrication occurs with the workpiece disposed in a liquid photopolymerizable composition, with a surface of the workpiece slightly below the surface. Light from a laser or other light beam is used to selectively photopolymerize a layer onto the workpiece, following which it is lowered further into the liquid composition by an amount corresponding to a layer thickness and the next layer is formed.

Polymer components can also be fabricated using selective heat sintering (SHS), which works analogously for thermoplastic powders to SLS for metal powders. Another additive manufacturing process that can be used for polymers or metals is fused deposition modeling (FDM), in which a metal or thermoplastic feed material (e.g., in the form of a wire or filament) is heated and selectively dispensed onto the workpiece through an extrusion nozzle.

The terminology used herein is for the purpose of describing particular embodiments only and is not intended to be limiting of the embodiments. While the description of the present embodiments has been presented for purposes of illustration and description, it is not intended to be exhaustive or limited to the embodiments in the form disclosed. Many modifications, variations, alterations, substitutions or equivalent arrangement not hereto described will be apparent to those of ordinary skill in the art without departing from the scope and spirit of the embodiments. Additionally, while various embodiments have been described, it is to be understood that aspects may include only some of the described embodiments. Accordingly, the embodiments are not to be seen as limited by the foregoing description, but are only limited by the scope of the appended claims.

What is claimed is:

1. A tubular heat exchanger, comprising:

a first flow path to receive a first fluid flow, wherein the first flow path is defined by a conduit; and a support structure with a plurality of support structure openings, wherein:

the support structure comprises a bottom having a curvature and a first length, a top having a curvature, which is similar to the curvature of the bottom, and a second length exceeding the first length, and intermediate layers having curvatures that are similar to the curvatures of the top and the bottom and lengths that exceed the first length and are exceeded by the second length, the support structure supports the conduit such that the first flow path extends in a serpentine configuration through the support structure with straight sections extending through the intermediate layers along longitudinal axes that are transverse to the curvatures of the bottom, the top and the intermediate layers and hairpin sections extending through the intermediate layers and connecting pairs of straight sections, wherein the support structure supporting the conduit fully encases the hairpin sections and the straight sections, the plurality of support structure openings define a second flow path to receive a second fluid flow, and the first flow path is in thermal communication with the second flow path.

2. The heat exchanger of claim 1, wherein the support structure surrounds the first flow path.

3. The heat exchanger of claim 1, wherein the first flow path is a plurality of conduits.

4. The heat exchanger of claim 3, wherein the plurality of conduits is a plurality of staggered conduits.

5. The heat exchanger of claim 3, wherein the plurality of conduits is a plurality of layered conduits.

6. The heat exchanger of claim 1, wherein the support structure is a lattice with at least one of regular shaped lattice ligaments and irregular shaped lattice ligaments.

7. The heat exchanger of claim 1, wherein the support structure is porous material foam.

8. The heat exchanger of claim 7, wherein the support structure is metallic.

9. The heat exchanger of claim 7, wherein the support structure is polymeric.

10. The heat exchanger of claim 1, wherein the heat exchanger is of monolithic construction.

11. The heat exchanger of claim 1, wherein the heat exchanger is formed from additive manufacturing techniques.

12. A heat exchanger, comprising:

a support structure formed into successive layers of similar curvatures and increasing length to define openings;

a conduit, which is disposed to extend through the support structure in a serpentine arrangement with straight sections extending through the successive layers and hairpin sections extending through the successive layers and connecting pairs of straight sections, wherein the support structure supporting the conduit fully encases the hairpin sections and the straight sections, the straight sections being disposed in groups within corresponding ones of the successive layers such that the groups have a curvature.

13. The heat exchanger according to claim 12, wherein the support structure comprises at least one of porous metallic foam, metallic material and polymeric material.

14. The heat exchanger according to claim 12, wherein a number of the straight sections in each group increases for each successive layer of increasing length.

15. The heat exchanger according to claim 12, wherein each straight section is staggered relative to a neighboring straight section of an immediately successive layer.

16. The heat exchanger according to claim 12, wherein the groups of the straight sections have curvatures which are similar to the similar curvatures of the successive layers.

* * * * *